US012042695B1

(12) United States Patent
Vujicic et al.

(10) Patent No.: US 12,042,695 B1
(45) Date of Patent: Jul. 23, 2024

(54) COMBINED CLIMBER AND ROWING EXERCISE MACHINE

(71) Applicant: NPD Team, LLC, Tustin, CA (US)

(72) Inventors: Marko Vujicic, Huntington Beach, CA (US); Greg Wallace, Mission Viejo, CA (US)

(73) Assignee: SKI-Row, Inc., Tustin, CA (US)

( * ) Notice: Subject to any disclaimer, the term of this patent is extended or adjusted under 35 U.S.C. 154(b) by 230 days.

(21) Appl. No.: 17/842,732

(22) Filed: Jun. 16, 2022

Related U.S. Application Data

(60) Provisional application No. 63/211,107, filed on Jun. 16, 2021.

(51) Int. Cl.

| | |
|---|---|
| ***A63B 22/00*** | (2006.01) |
| ***A63B 21/00*** | (2006.01) |
| ***A63B 21/008*** | (2006.01) |
| ***A63B 21/22*** | (2006.01) |
| ***A63B 22/20*** | (2006.01) |
| ***A63B 23/035*** | (2006.01) |

(52) U.S. Cl.
CPC .. *A63B 23/03575* (2013.01); *A63B 21/00192* (2013.01); *A63B 21/0088* (2013.01); *A63B 21/225* (2013.01); *A63B 21/4034* (2015.10); *A63B 21/4035* (2015.10); *A63B 22/001* (2013.01); *A63B 22/0046* (2013.01); *A63B 22/205* (2013.01); *A63B 23/03558* (2013.01); *A63B 2022/0079* (2013.01); *A63B 2225/105* (2013.01)

(58) Field of Classification Search
None
See application file for complete search history.

(56) References Cited

U.S. PATENT DOCUMENTS 1,850,530 A * 3/1932 Brown ..... A63B 22/0076 482/127
2,079,594 A * 5/1937 Clem ..... A61H 1/0259 482/37
4,625,962 A 12/1986 Street
(Continued)

FOREIGN PATENT DOCUMENTS

CN 106730592 A * 5/2017 ..... A63B 21/154
CN 108553807 A * 9/2018 ..... A63B 22/001
(Continued)

*Primary Examiner* — Shila Jalalzadeh Abyaneh
(74) *Attorney, Agent, or Firm* — Eric Karich; Karich & Associates

(57) ABSTRACT

An exercise machine has a base supporting a boom. The boom has an elongate rigid body that is attached at a proximal end via a pivot mount to the base such that the boom is able to pivot about an axis with respect to the base between a rowing configuration wherein the boom is horizontal, and a climbing configuration wherein the boom extends upwardly. A seat element is slidably mounted above the boom when the boom is in the rowing configuration. A row handle is attached to a row transmission system that includes a row cable that extends to a row resistance device. The boom has a pair of climb handles and a pair of climb pedals, each slidably mounted on the boom, for performing climbing exercises. A climber transmission system connects the climb handles and climb pedals to a climber resistance device.

10 Claims, 13 Drawing Sheets

(56) References Cited

U.S. PATENT DOCUMENTS

| | | | | | |
|---|---|---|---|---|---|
| 4,709,918 | A | | 12/1987 | Grinblat | |
| 4,733,858 | A | * | 3/1988 | Lan | A63B 21/4047 482/53 |
| 4,911,438 | A | * | 3/1990 | Van Straaten | A63B 21/068 482/130 |
| 4,974,832 | A | * | 12/1990 | Dalebout | A63B 21/4029 482/142 |
| 5,354,251 | A | * | 10/1994 | Sleamaker | A63B 21/4047 482/142 |
| 5,409,435 | A | | 4/1995 | Daniels | |
| 5,492,515 | A | * | 2/1996 | Charnitski | A63B 22/001 482/37 |
| 5,496,241 | A | * | 3/1996 | Sellers | A63B 22/203 482/64 |
| 5,928,115 | A | * | 7/1999 | Arroyo, Jr. | A63B 22/0605 482/62 |
| 5,951,449 | A | | 9/1999 | Oppriecht | |
| 6,071,215 | A | * | 6/2000 | Raffo | A63B 22/0076 72/142 |
| 7,204,790 | B2 | * | 4/2007 | Sleamaker | A63B 21/4029 482/142 |
| 8,323,157 | B2 | * | 12/2012 | Campanaro | A63B 21/068 482/142 |
| 8,517,899 | B2 | | 8/2013 | Zhou | |
| 8,814,763 | B2 | * | 8/2014 | Ho | A63B 22/205 482/142 |
| 10,179,260 | B1 | * | 1/2019 | Stearns | A63B 21/4034 |
| 10,279,214 | B2 | | 5/2019 | Chiang | |
| 10,449,409 | B2 | | 10/2019 | Hamilton | |
| 10,792,536 | B2 | * | 10/2020 | Liu | A63B 21/157 |
| 10,828,530 | B1 | * | 11/2020 | Vujicic | A63B 21/153 |
| 11,013,954 | B2 | * | 5/2021 | Schwarz | A63B 21/0428 |
| 11,052,279 | B1 | * | 7/2021 | Vujicic | A63B 21/4035 |
| 11,738,235 | B2 | * | 8/2023 | Stearns | A63B 21/068 482/52 |
| 2002/0198082 | A1 | * | 12/2002 | Arroyo | A63B 22/0005 482/37 |
| 2004/0248713 | A1 | | 12/2004 | Campanaro | |
| 2007/0203004 | A1 | | 8/2007 | Campanaro | |
| 2007/0270287 | A1 | * | 11/2007 | McDonnell | A63B 21/00 482/72 |
| 2009/0137370 | A1 | * | 5/2009 | Kushnir | A63B 21/151 482/120 |
| 2011/0281698 | A1 | | 11/2011 | Wyeroski | |
| 2016/0001123 | A1 | * | 1/2016 | Parrish, Jr. | A63B 22/0076 482/142 |
| 2016/0059060 | A1 | * | 3/2016 | Lagree | A63B 21/023 482/92 |
| 2019/0160331 | A1 | * | 5/2019 | Mercenari Uribe | A63B 21/018 |
| 2020/0171346 | A1 | * | 6/2020 | Chen | A63B 22/205 |

FOREIGN PATENT DOCUMENTS

| | | | | | |
|---|---|---|---|---|---|
| CN | 109126027 | A | * | 1/2019 | A63B 22/0076 |
| CN | 109200534 | A | * | 1/2019 | A63B 22/04 |
| CN | 109248396 | A | * | 1/2019 | |
| CN | 111760250 | A | * | 10/2020 | |
| CN | 112870632 | A | * | 6/2021 | A63B 22/0076 |
| ES | 2793235 | T3 | * | 11/2020 | A63B 21/00065 |
| WO | WO-2009102187 | A1 | * | 8/2009 | A63B 21/00072 |

* cited by examiner

COMBINED CLIMBER AND ROWING EXERCISE MACHINE

CROSS-REFERENCE TO RELATED APPLICATIONS

This application for a utility patent claims the benefit of U.S. Provisional Application No. 63/211,107, filed Jun. 16, 2021.

BACKGROUND OF THE INVENTION

Field of the Invention

This invention relates generally to exercise machines, and more particularly to an exercise machine that combines the functionality of a climber and a rowing exercise machine.

Description of Related Art

The prior art teaches a variety of rowing exercise machines, in particular applicant has registered Vujicic, U.S. Pat. No. 11,052,279, which teach a rowing machine that also includes a pair of handles mounted on a vertical boom, so they may be pulled down to simulate a skiing exercise. This exercise machine has a base housing and a boom that extends from a proximal end to a distal end. The boom is able to pivot between a rowing configuration wherein the boom is generally horizontal, and a skiing configuration wherein the boom is generally vertical. A rowing assembly includes a row handle attached to a row chain which extends into the base housing, to a row recoil device. A ski assembly includes a pair of ski handles, each ski handle being attached to a ski rope which extends into the base housing, to a ski recoil device. A transmission system has a shaft that is operably connected to a resistance device, the shaft having a row sprocket and a pair of ski spools, and the cables contact the spools so that movement of one of the cables rotates the respective spool, thereby rotating the shaft.

Applicant has also registered Vujicic, U.S. Pat. No. 10,828,530, which teaches a similar device wherein the exercise machine has a base housing, a boom having an elongate rigid body that extends from a proximal end to a distal end, and a pivot mount which pivotally mounts the proximal end of the boom on the base housing such that the boom is able to pivot with respect to the base housing between a rowing configuration wherein the boom is generally horizontal, and a skiing configuration wherein the boom is generally vertical. A seat element is slidably mounted on the boom, and ski handles attached to a ski cable which extend through ski handle stops at the distal end of the boom. A row handle is also attached to a row cable that extends from the base housing. The exercise machine further includes a resistance device, and a transmission system that connects the ski cable and the row cable to the resistance device.

Another rowing exercise device is shown in Chiang, U.S. Pat. No. 10,279,214, which shows a rowing device that includes adjustable handlebars that allows the user to utilize the rowing mechanism for a variety of additional exercises.

The prior art teaches rowing exercise machines. However, the prior art does not teach a rowing exercise machine that be pivoted from horizontal to vertical to enable a climbing exercise on the beam used for supporting the user in the rowing exercises. The present invention fulfills these needs and provides further advantages, as described in the following summary.

SUMMARY OF THE INVENTION

The present invention teaches certain benefits in construction and use which give rise to the objectives described below.

The present invention provides an exercise machine having a base for supporting the exercise machine, and a boom having an elongate rigid body that extends from a proximal end attached to the base, to a distal end. A pivot mount pivotally mounts the proximal end of the boom on the base such that the boom is able to pivot about an axis with respect to the base between a rowing configuration wherein the boom is horizontal, and a climbing configuration wherein the boom extends upwardly. A seat element is slidably mounted above the boom when the boom is in the rowing configuration. A row handle is attached to a row transmission system that includes a row cable that extends to a row resistance device, the row handle being positioned so that when exercise machine is in the rowing configuration and the user is seated on the seat element, he or she can grasp the row handle and perform rowing exercises. The boom has a pair of climb handles and a pair of climb pedals slidably mounted on the boom, for performing climbing exercises. A climber transmission system connects the climb handles and climb pedals to a climber resistance device.

A primary objective of the present invention is to provide an exercise machine having advantages not taught by the prior art.

Another objective is to provide an exercise machine adapted to pivot between a rowing configuration and a climbing configuration.

A further objective is to provide an exercise machine that includes a pair of climb handles and a pair of climb pedals, and a pair of row pedals and a row handle.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an exercise machine that includes a combined climber exercise machine and a rowing exercise machine in a single unit. While one exemplary embodiment of the exercise machine is described in greater detail below, those skilled in the art may devise alternative or equivalent embodiments that may be used, and these alternative embodiments should be considered within the scope of the present invention.

Figure 1:
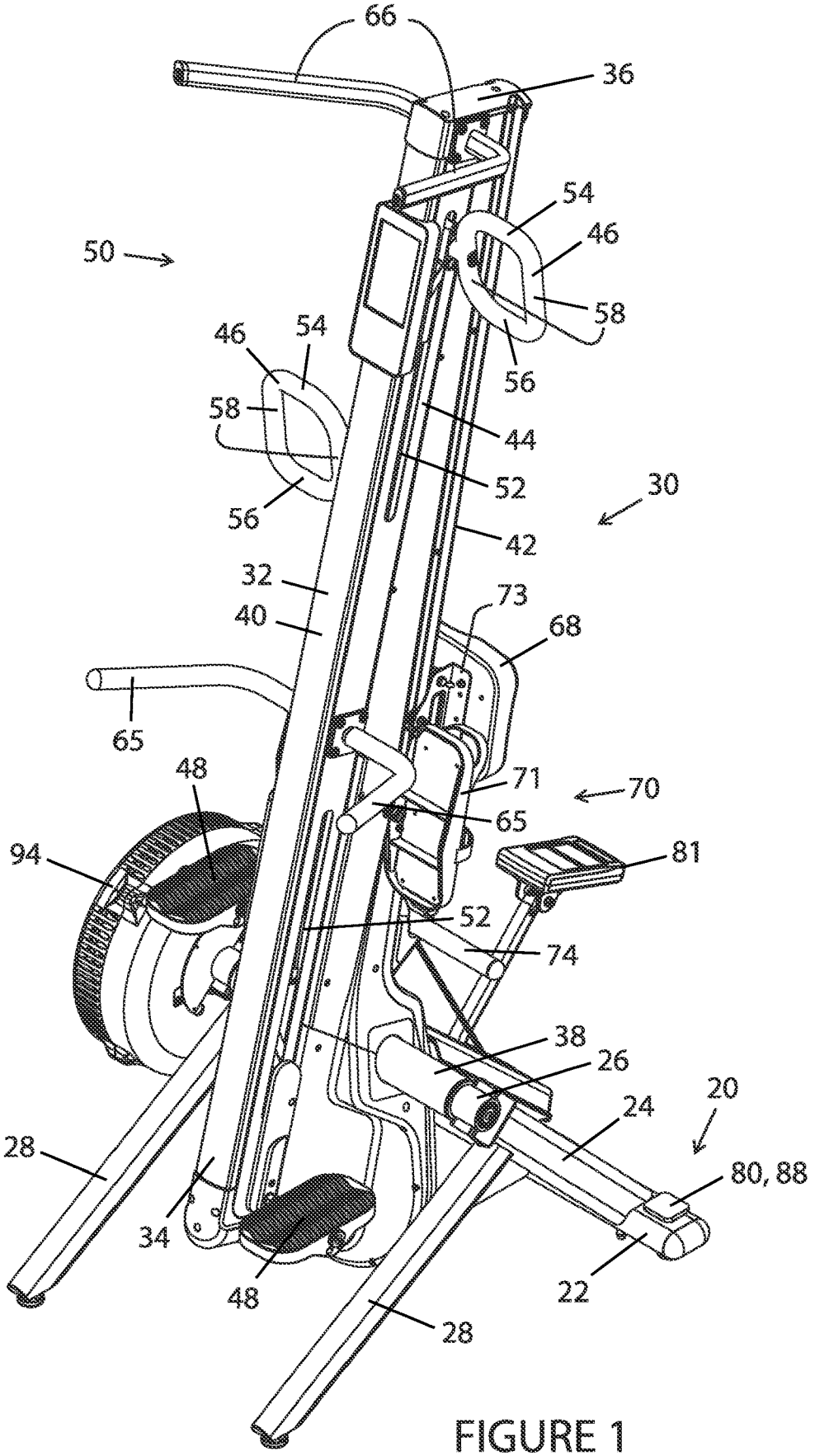
FIG. 1 is a front perspective view of an exercise machine in a climbing configuration.
Figure 2:
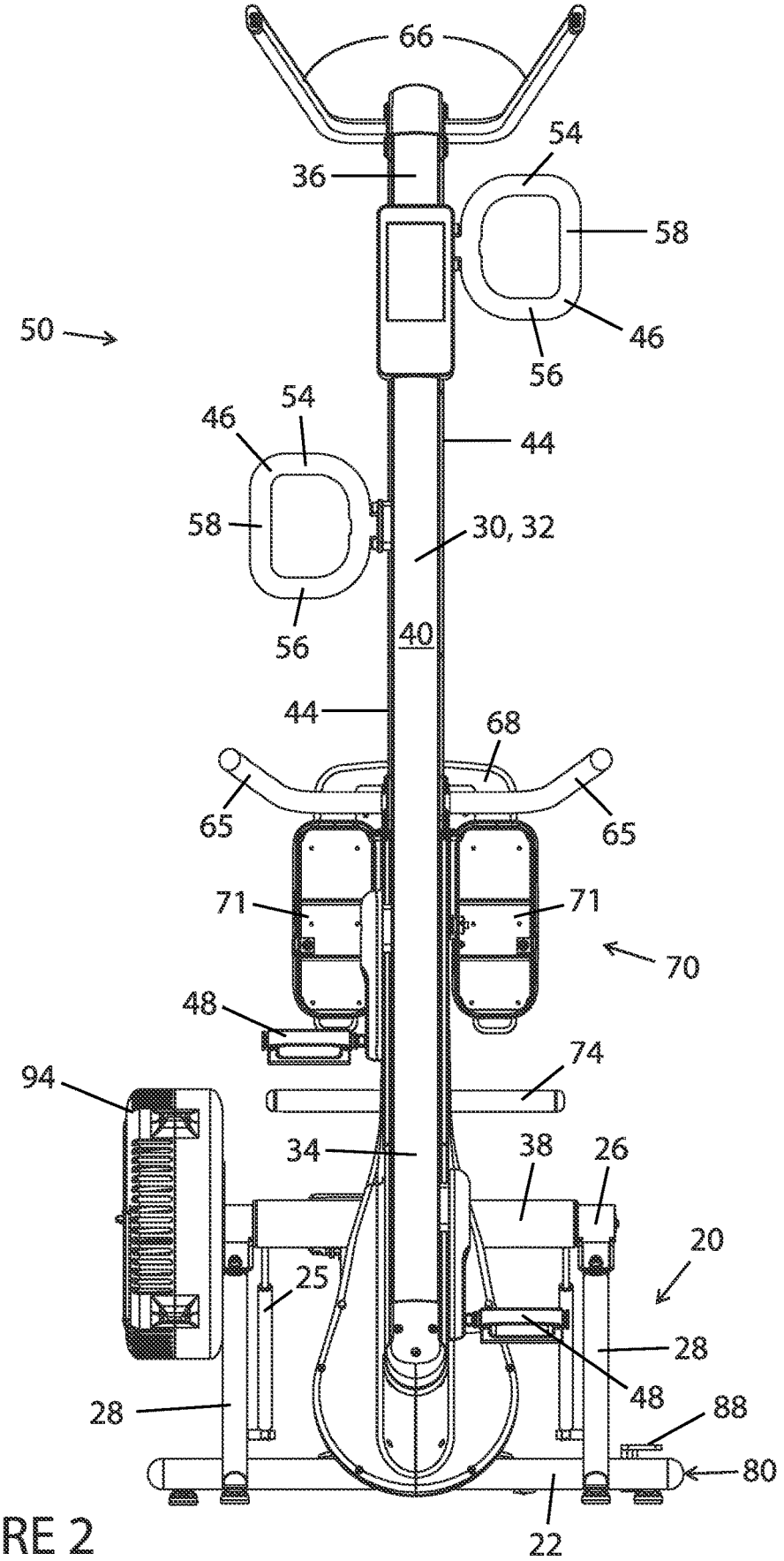
FIG. 2 is a front elevational view thereof.
Figure 3:
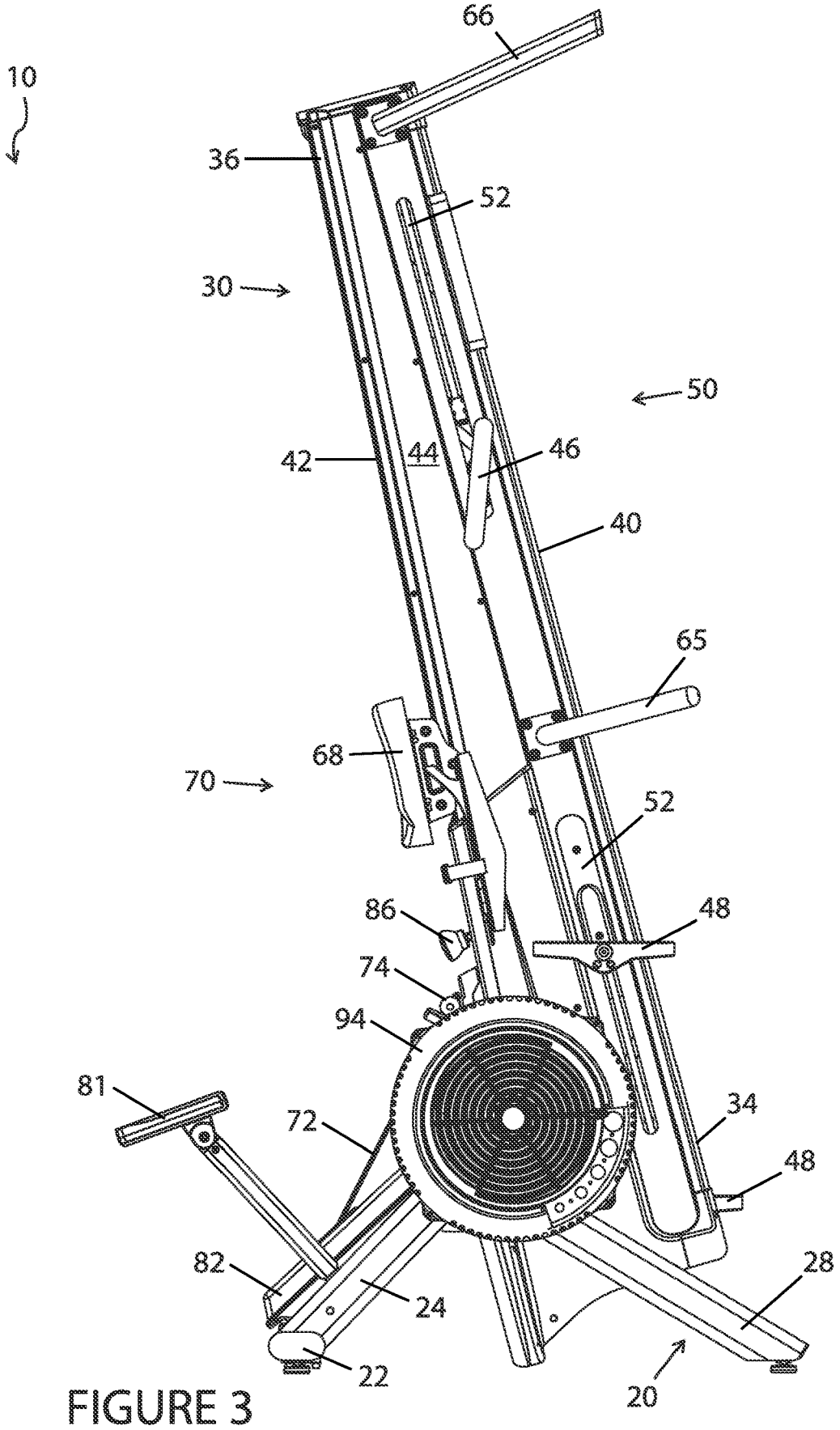
FIG. 3 is a side elevation view thereof.
Figure 4:
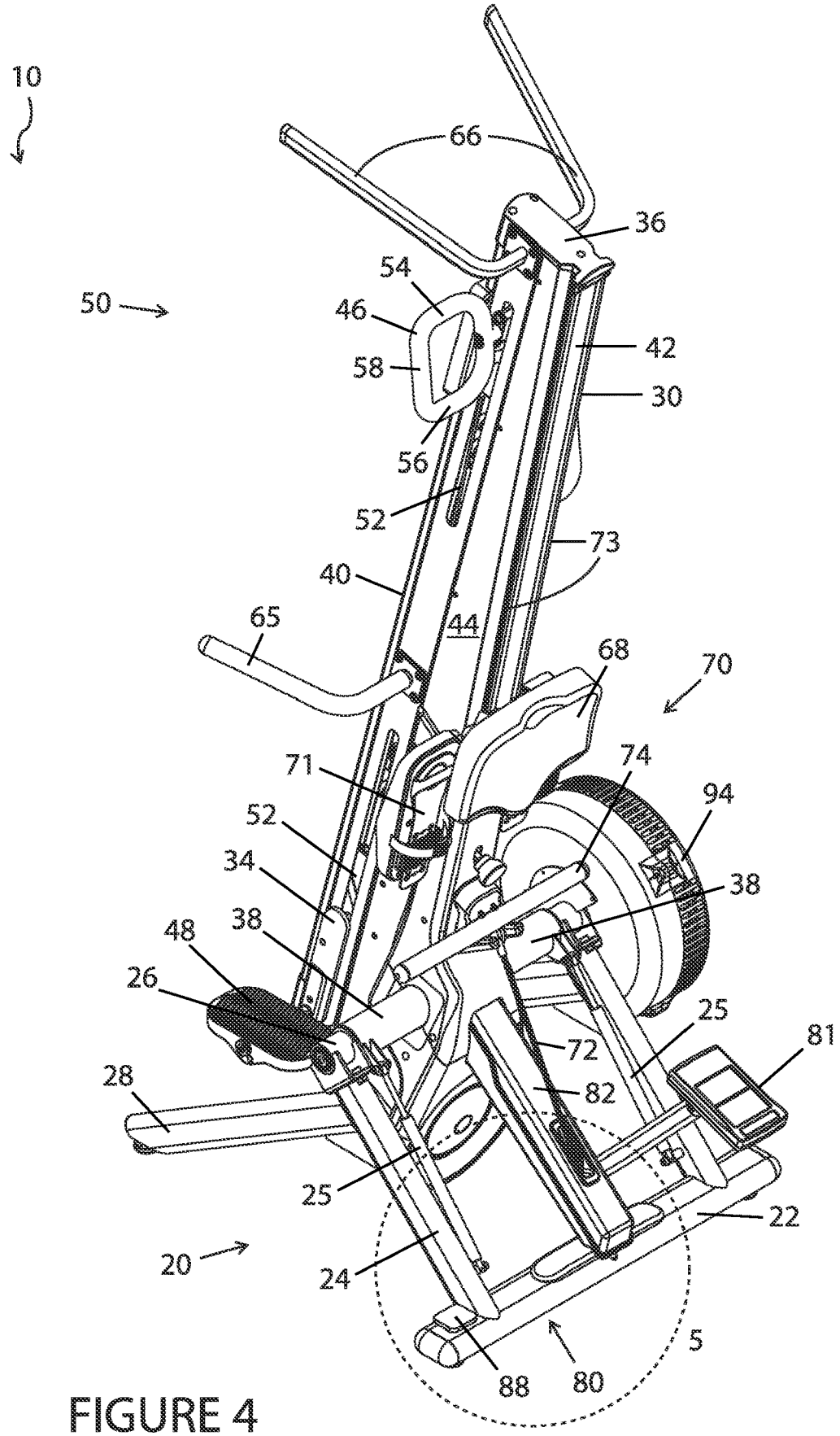
FIG. 4 is a rear perspective view thereof.
Figure 9:
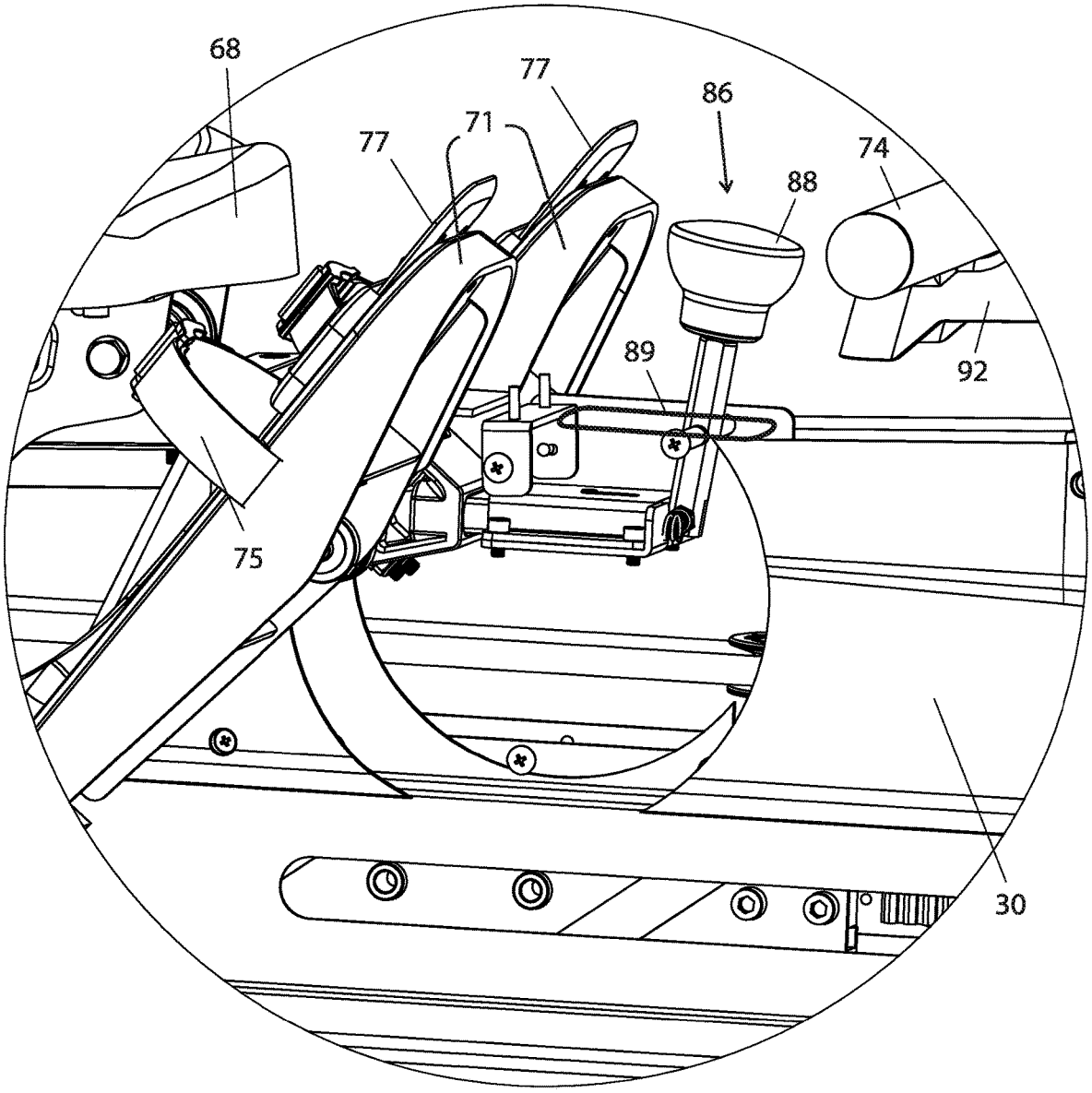
FIG. 9 is a close up perspective view of a foot rest locking mechanism of the exercise machine.
Figure 10:
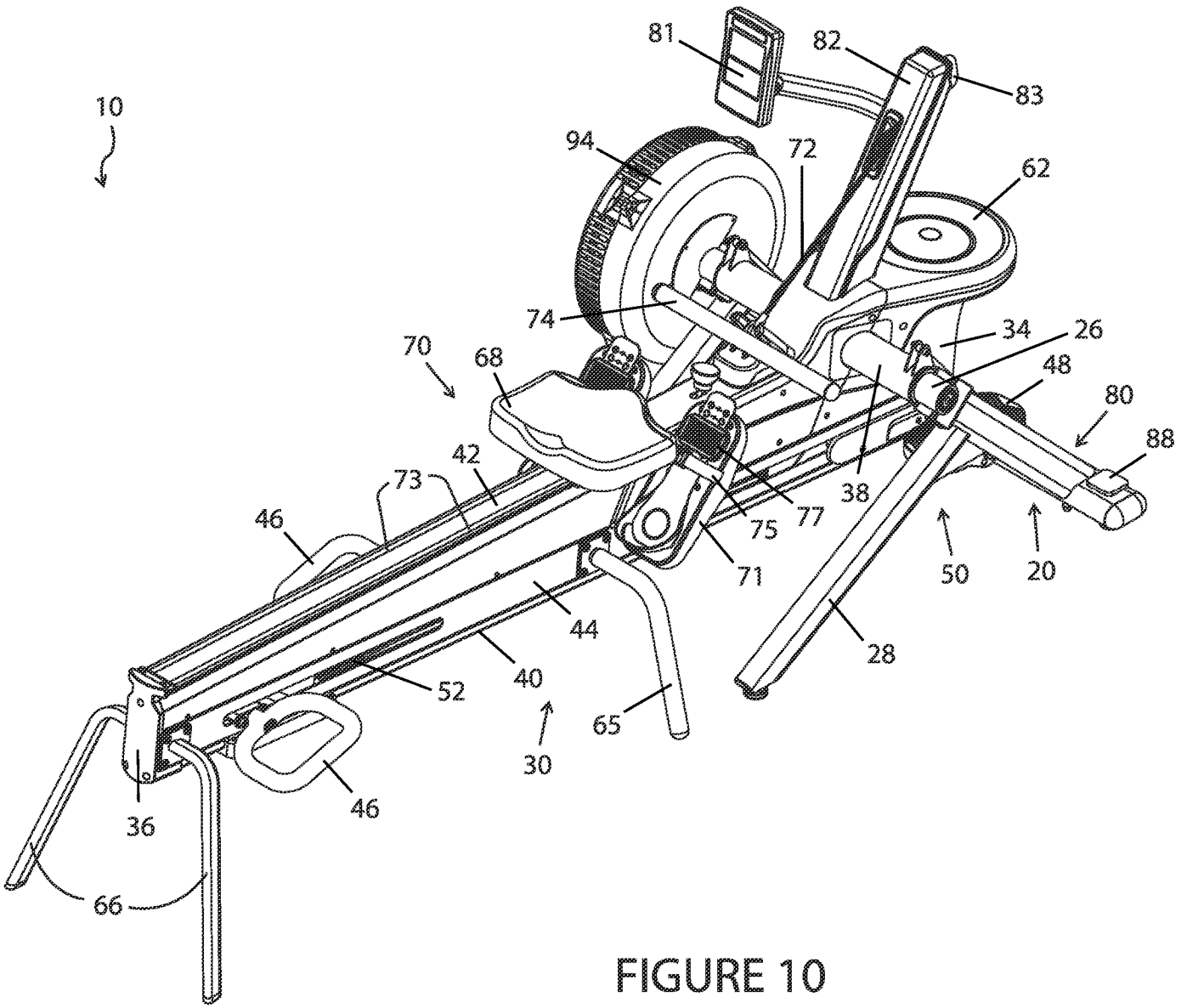
FIG. 10 is a perspective view of the exercise machine in a rowing configuration.

FIG. 1 is a front perspective view of an exercise machine 10 in a climbing configuration. FIG. 2 is a front elevational view of this exercise machine 10, FIG. 3 is a side elevation view thereof, and FIG. 4 is a rear perspective view thereof. As shown in FIGS. 1-4, the exercise machine 10 of this embodiment includes a base 20 for supporting the exercise machine 10 upon a ground surface, and a boom 30 having an elongate rigid body that extends from a proximal end 34 to a distal end 36, each described in greater detail below. A pivot mount 26 pivotally mounts the proximal end 34 of the boom 30 on the base 20 such that the boom 30 is able to pivot about an axis with respect to the base 20 between the climbing configuration wherein the boom 30 extends upwardly as shown in FIGS. 1-4, and a rowing configuration wherein the boom 30 is horizontal, as shown in FIGS. 9-10.

As shown in FIGS. 1-4, in the climbing configuration the exercise machine 10 is adapted for use by a user in performing climbing exercises using a climbing assembly 50, and in the rowing configuration, rowing exercises may be performed using a rowing assembly 70, each described in greater detail below.

As shown in FIGS. 1-4, the base 20 is sized and shaped to support the exercise machine 10 upon a ground surface. In this embodiment, the base 20 includes a lateral support structure 22 that supports a pair of rear legs 24, and a pair of front legs 28 that extend downwardly from rear legs 24 to contact the ground. While one example of the base 20 is illustrated and discussed herein, other shapes and structures may be implemented, e.g., a generally cuboid frame or plate, a different arrangement of support legs and struts, and any other equivalent structure known in the art.

In this embodiment, the base 20, in this case the rear legs 24, support the pivot mount 26 for engaging both ends of a lateral tube 38 extending from the boom 30. The lateral tube 38 has an axis A. The pivot mount 26 enables the boom 30 to pivot between the rowing and climbing configurations.

One or more hydraulic cylinders 25 (shown in FIG. 2) may extend between the lateral tube 38 (or the boom 30 itself) and the base 20 for providing a lifting bias to the beam for facilitating lifting the boom 30 to the climbing configuration, so not as much force is required to lift the boom 30. In some embodiments, an adjustment mechanism (not shown) may be included for adjusting the vertical angle of the boom 30 to different desired degrees, e.g., a pin lock, an actuator or motor, different forms of locking mechanisms, and/or any other adjustment mechanism known in the art, so the user may perform exercises at various inclines to adjust difficultly or target specific muscles. However, in the illustrated embodiment, it adjusts between two fixed configurations.

As shown in FIGS. 1-4, the elongate rigid body of the boom 30 further comprises a bottom surface 40, a top surface 42, and side surfaces 44. The climbing assembly 50 includes a pair of climb handles 46 and a pair of climb pedals 48, each of which may be slidably mounted to and extending outwardly from one of the side surfaces 44 of the boom 30, for performing climbing exercises. In some embodiments, the handles 46 and foot pedals 48 ride up and down along tracks 52 in the side surfaces 44 of the boom 30.

In this configuration, the climb handles 46 are mounted a suitable height above the climb pedals 48, which may be adjustable, i.e., via an adjustment mechanism (not shown). In some embodiments, the climb handles 46 are each adapted to be moved between at least three fixed positions, although any arrangement known in the art may be used. In other embodiments each handle's 46 position may be infinitely adjustable between two end points. In some constructions, the climb pedals 48 may be weighted so that they are biased towards a proper angle for use, so that they face upwardly to receive the user's feet.

In this embodiment, each of the climb handles 46 includes a generally rectangular frame having a top crossbar 54 and a bottom crossbar 56 spaced a distance from each other by a side bars 58 so a user may grip the climb handles 46 at different positions and at different angles. However, other forms of climb handles 46 may be used or included, e.g., a single horizontal bar, a bar of other shape and configuration, fabric/rubber loops, etc., or any other suitable alternative known in the art. Furthermore, in some embodiments, additional climb handles 46 may be included, i.e., for different heights/widths and various potential exercises.

Figure 6:
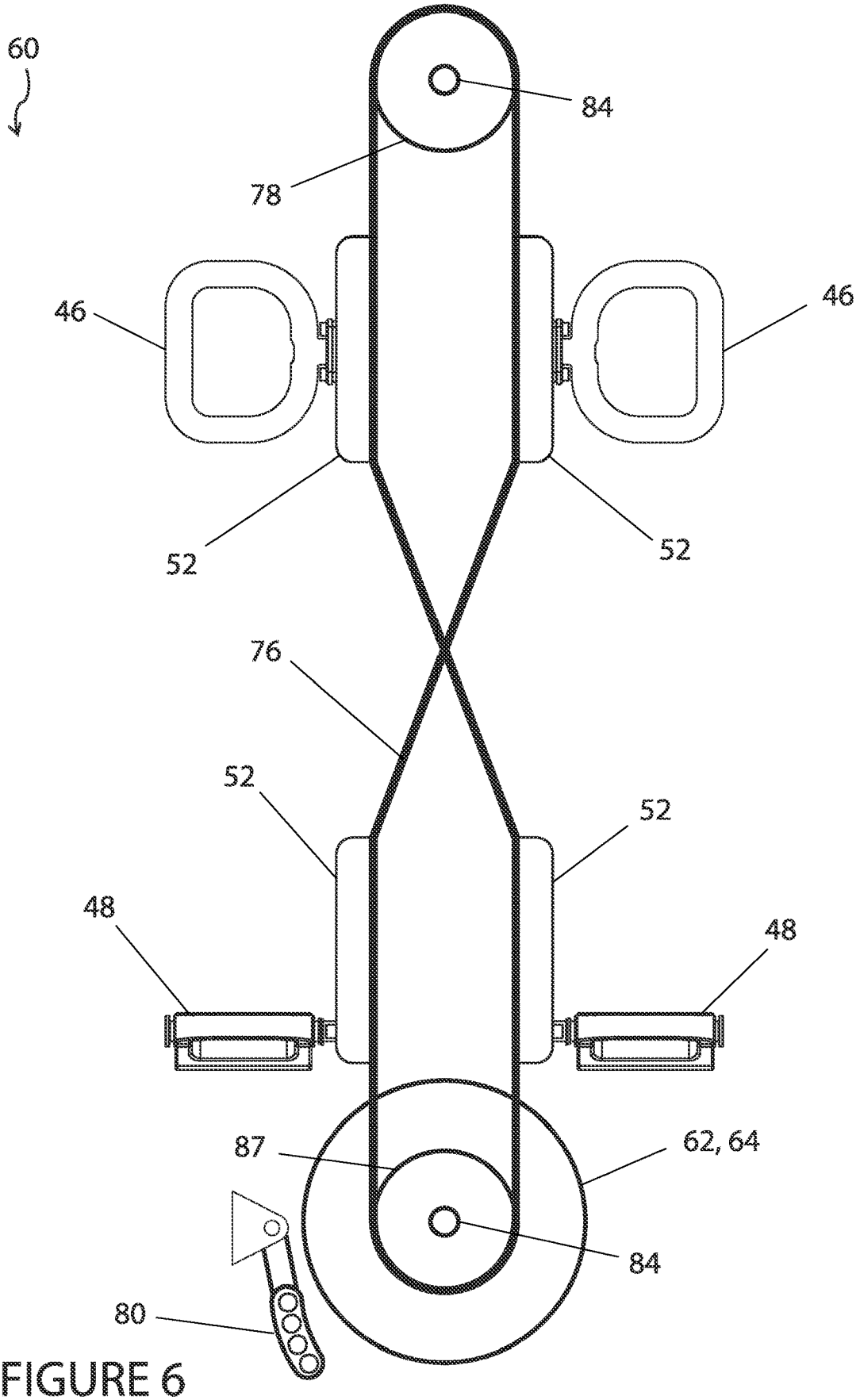
FIG. 6 is a schematic drawing of a first embodiment of a climber transmission of the exercise machine.
Figure 7:
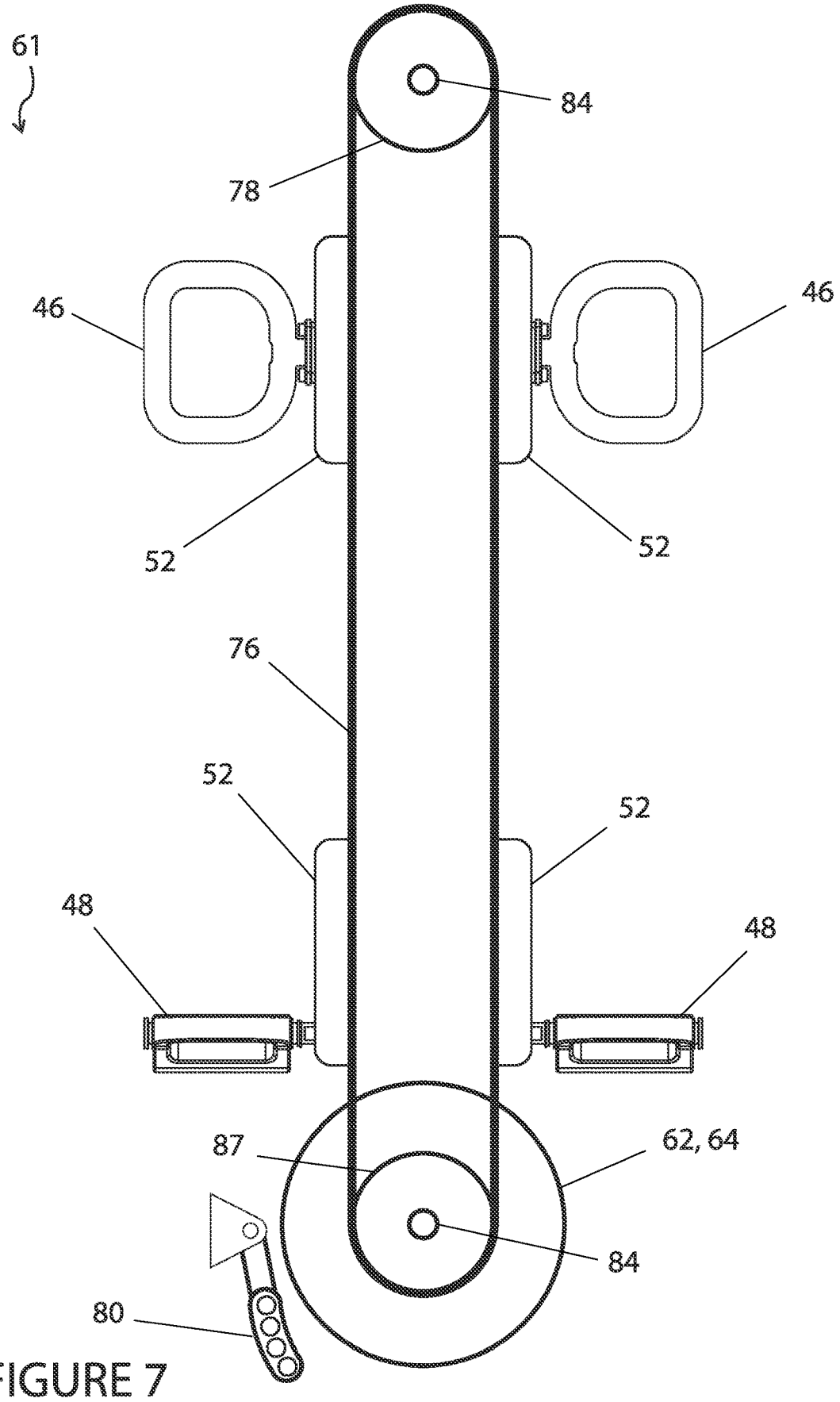
FIG. 7 is a schematic drawing of a second embodiment of the climber transmission.
Figure 8:
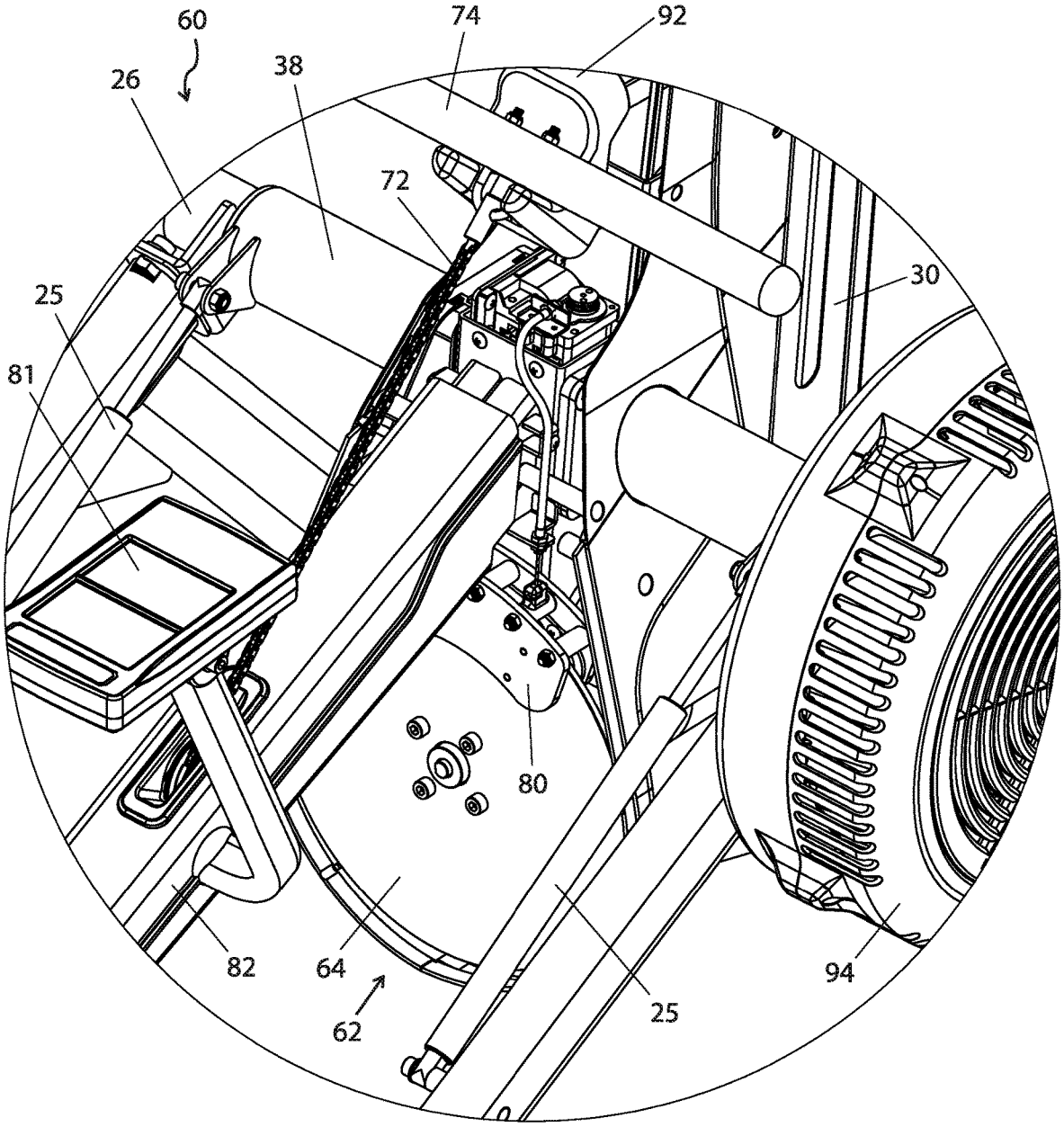
FIG. 8 is a close up perspective view of a climber resistance device of the exercise machine.

The climb handles 46 and the climb pedals 48 are linked together by a climber transmission system 60 (shown in FIGS. 6 and 7), which is operably connected to a climber resistance device 62 (also shown in FIGS. 6 and 7, as well as FIG. 8). In this embodiment, the boom 30 is a hollow construction that houses the climber transmission 60 so that it is not exposed.

As illustrated in FIGS. 1-4, the boom 30 may further include a pair of legs 65 extending outwardly and downwardly from the boom 30. In the current embodiment, the legs 65 are located approximately midway between the proximal and distal ends 34 and 36 for supporting the boom 30 in the in the horizontal rowing configuration (best shown in FIGS. 10-11). In other embodiments, however, they may be located at different locations of the boom 30, so long as they are able to support the boom 30 and the weight of the user while the machine is in operation.

The boom 30 may further include one or more climbing handles 66 that may extend outwardly from the boom 30 for enabling additional climbing exercises, e.g., for pull-ups/chin-ups, hanging abdominal curls, etc. In this embodiment, the climbing handles 66 are fixed and extend from adjacent the distal end of the boom 30; however, in alternative embodiments, they may be positioned elsewhere on the boom 30, and they may be mounted on a hinge or joint (not shown) to facilitate movement of the handles 66 if necessary so that they don't interfere with other exercises. In this embodiment, the handles 66 do not contact the ground in the rowing configuration; however, in alternative embodiments, they might do so, to provide additional support.

When the boom 30 is in the raised climbing configuration as shown in FIGS. 1-4, it may be desired for a portion of the boom 30 to interlock with the base 20 so that the boom 30 is locked in position. As shown in FIG. 4, in this embodiment, an elongate member 82 extending from the boom 30 includes an interlocking feature 83 that removably interlocks with the base 20 for removably interlocking them. In this embodiment, the interlocking feature 83 interlocks with a base locking mechanism 80 shown in FIG. 5, and discussed in more detail below.

Figure 5:
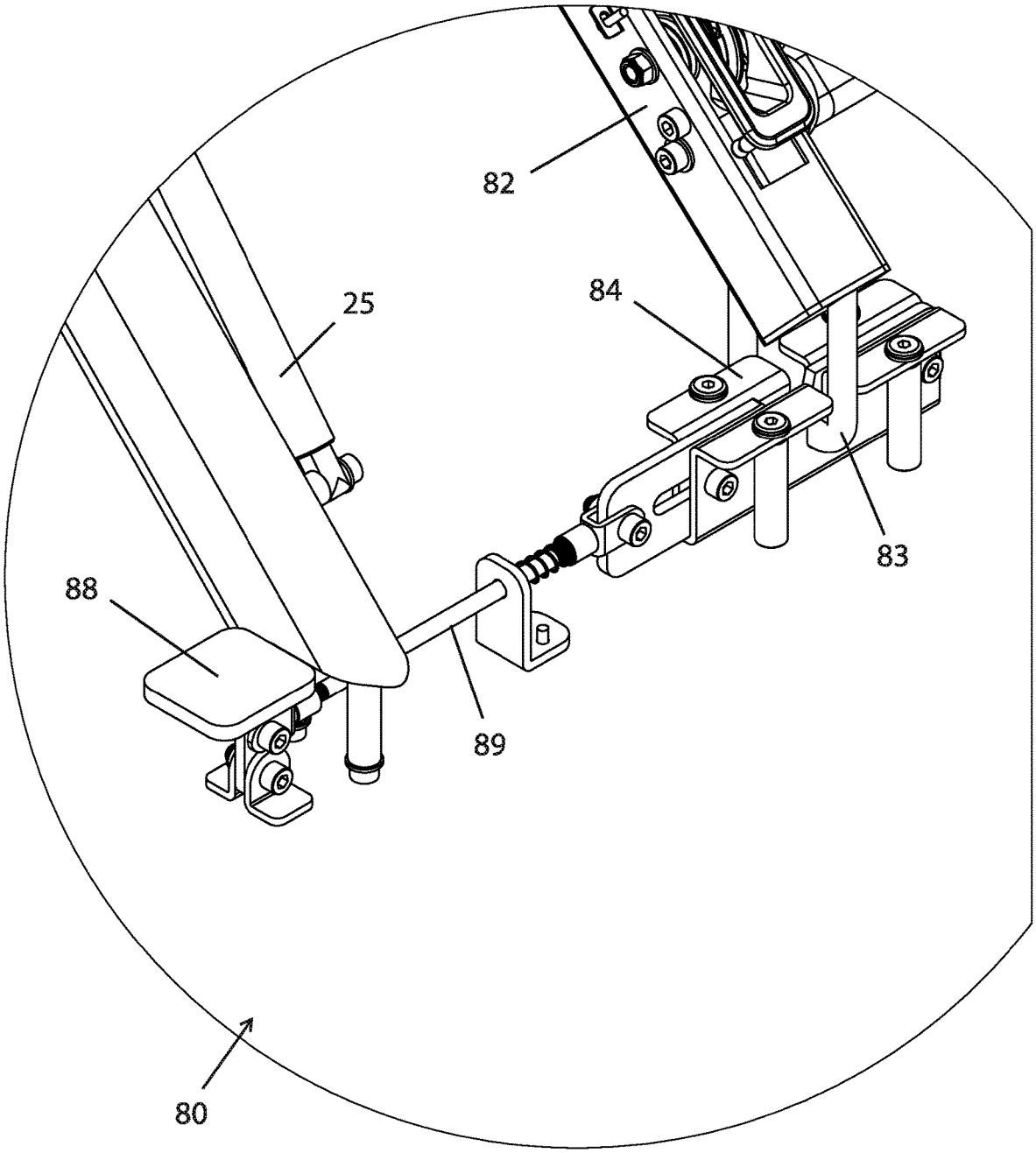
FIG. 5 is a close up perspective view of an area shown by line 5 in FIG. 4, illustrating a base locking mechanism of the exercise machine.

FIG. 5 is a close up perspective view of a base locking mechanism 80 of the exercise machine 10. FIG. 5 shows the base locking mechanism 80 without the external structure that is shown in FIG. 4, for more clearly showing the internal structure. As shown in FIG. 5, the base locking mechanism 80 interlocks with the interlocking feature 83 fixedly connected with the boom 30 to hold the boom 30 in the climbing configuration. In this embodiment, the base locking mechanism 80 is incorporated into the lateral support leg 22 of the base 20, and the base locking mechanism 80 includes a receiver 84 with a release mechanism 86 for receiving and securing the interlocking feature 83, in this case in the form of a ring. In this embodiment, the release mechanism is in the form of a foot release pad 88 connected to the receiver 84 via a spring assembly 89, wherein the foot release pad 88 may be pressed to contract the spring assembly 89 and release the D ring 83 from the receiver 84. In alternative embodiments, the receiver 84 may be in the form of a hooking portion, or any other suitable structure that is capable of engagement with the ring 83. Alternative locking mechanisms may be implemented other than the one described, and the invention includes any other suitable interlocking mechanism known in the art.

The base locking mechanism 80 may alternatively be in the form of a motor or other form of actuator that moves the boom 30 between different positions and also serves to lock the boom 30 in the selected position.

FIG. 6 is a schematic drawing of a first embodiment of the climber transmission 60 of the exercise machine 10. The climber transmission 60 connects the climb handles 46 and climb pedals 48 to the climber resistance device 62. As shown in FIG. 6, the climber transmission system 60 comprises a cable 76 that connects all of the elements. In this embodiment, the cable 76 extends around a pulley 78 and around the climber resistance device 62 (discussed further in FIG. 8) and connects each of the climb handles 46 with the opposite climb pedal. In the embodiment of FIG. 6, the cable 76 extends around the pulley 78 and the climber resistance device 62 in a contralateral configuration, crossing between the climber handles 46 and the climber pedals 48.

In this embodiment, the pulley 78 may be positioned within the boom 30 at the distal end 36 of the boom 30, but it may be positioned anywhere that is suitable for performing climbing exercises. In some embodiments, additional pulleys may be included, e.g., a bottom pulley 87 positioned within the proximal end 34 of the boom 30, for receiving the cable(s) 76 of the climber transmission 60. Each pulley may be supported by a shaft and bearings 84, wherein at least one of the pulleys is connected to a flywheel 64 via its shaft to drive the resistance device 62, in this case the flywheel 64, in a reciprocating motion.

In this embodiment, when the climbing assembly 50 is in use, the climb handle on the left side moves in unison with the climb pedal on the right side, and the climb handle on the right and the climb pedal on the left side move in unison, for contralateral climbing movements.

As shown in FIG. 8, in this embodiment, the climber resistance device 62 further comprises a resistance mechanism for adjusting the amount of resistance provided by the device 62. In this embodiment, the reciprocating flywheel 64 is adjacent a magnetic component 80 movably mounted adjacent the reciprocating flywheel 64. The magnetic component 80 may move relative to the reciprocating flywheel 64 to adjust the amount of resistance provided (i.e., magnetically creating resistance on the spin of the flywheel 64). While a magnetic mechanism is used in this embodiment, the resistance mechanism may alternatively be a physical brake (e.g., based upon varying amounts of friction), and/or any other form of providing resistance known in the art.

FIG. 7 is a schematic drawing of a second embodiment 61 of the climber transmission. As shown in FIG. 7, in the second embodiment of the climber transmission 61, the cable 76 makes an open loop, and does not cross as shown in FIG. 6, so that the handles move in unison with their respective climbing pedal, for other forms of climbing exercises wherein the movement is not contralateral.

As used in this application, the term "cable" is defined to include any form of cable, rope, belt, cord, bungee, chain, or similar or equivalent element known in the art that is useful for the purposes described herein. For purposes of this application, the terms "pulley" "spool" and "sprocket" are defined to include any form of pulley, spool, cylinder, sprocket, or any other form of similar or equivalent mechanism known in the art for operatively engaging cables, as discussed herein.

FIG. 8 is a close up perspective view of the climber resistance device 62 of the exercise machine 10. This view illustrates the climber resistance device 62, and in particular the flywheel 64 and the magnetic component 80 pivotally mounted adjacent to the flywheel 64. A cable actuator functions to move the magnetic component 80 closer and further from the flywheel 64, as discussed above.

Also shown in FIG. 8, in this embodiment, the elongate member 82 is hollow in construction, and receives and houses a row cable 72 of a rowing transmission system 90 of the rowing assembly 70, the row cable 72 extending to a row handle 74 for performing rowing exercises, discussed further below. Furthermore, in this embodiment, the elongate member 82 may further have a computer display 81 attached thereto, for displaying feedback (e.g., calories burned, heart rate, etc.) or entertainment (e.g., an instructional video, television show, etc.) to the user in the rowing configuration. The machine may further include additional, optional features for providing data to the user, or the computer display 81 may be located elsewhere on the exercise machine 10.

FIG. 9 is a close up perspective view of rowing pedals 71 used for engaging a user's feet while rowing, and also an adjustable locking mechanism 86 that is used to selectively lock the rowing pedals 71 into different positions during use. In this embodiment, the rowing pedals 71 are locked in a planar position when the machine 10 is used for climbing, as shown in FIGS. 1-4, so that the rowing pedals 71 are not in the way of the climbing actions of the user. As shown in FIG. 9, the adjustable locking mechanism 86 may be used to unlock the rowing pedals 71 when the user wants to use the machine 10 for rowing, and move the rowing pedals 71 into an angled position for use in rowing.

In the embodiment of FIG. 9, the adjustable locking mechanism 86 is positioned on the top surface 42 of the boom 30 between the seat element 68 and a row handle receiver 92 for locking each of the rowing pedals 71 in either the planar position wherein the each of the rowing pedals 71 is aligned with the boom 30, as shown in FIGS. 1-4, or an angled position wherein each of the rowing pedals 71 is angled with respect to the boom 30, as shown in FIG. 9. However, the adjustable locking mechanism 86 may be positioned on any suitable location on or adjacent the boom 30.

In this embodiment, the adjustable locking mechanism 86 is in the form of an adjustment knob 880 positioned within an adjustment channel 89, wherein the user may grip the knob to slide it forward or backward within the channel. Movement within the channel may cause the rowing pedals 71 to automatically pivot with respect to the boom 30, or alternatively the user may manually pivot the rowing pedals 71, wherein the knob locks/unlocks them in place. In alternative implementations, the adjustable locking mechanism 86 may be any type of adjustment mechanism, e.g., a pin lock, clip, etc. The locking mechanism 86 may alternatively be in the form of a linkage (not shown) which causes the pedals to pivot as the boom 30 is moved, or they could be moved by a motor, actuator, or other similar device. Furthermore, in another embodiment, the adjustable locking mechanism 86 may be excluded.

Figure 11:
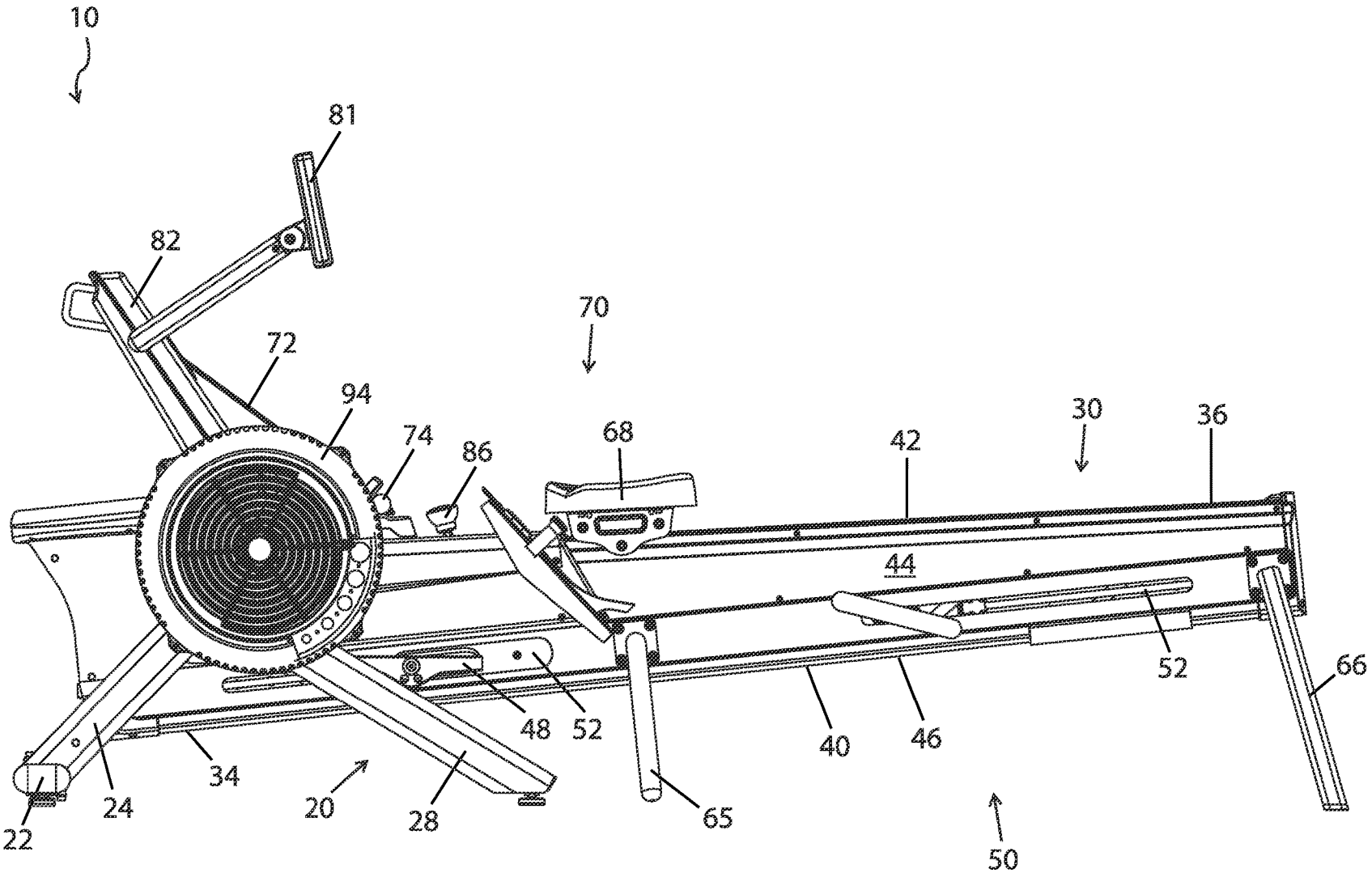
FIG. 11 is a side elevation view thereof.

FIG. 10 is a perspective view of the exercise machine 10 once the boom 30 has been lowered to the rowing configuration, and FIG. 11 is a side elevation view thereof. As shown in FIGS. 10-11, the boom 30 further includes a seat element 68 slidably mounted above the top surface 42, and a pair of rowing pedals 71 on either side surface 44 of the boom 30 for receiving the user's feet for performing rowing exercises. In the rowing configuration with the pair of legs 65 supporting the boom 30 horizontally, the user may use the rowing assembly 70 including the seat element 68, the rowing pedals 71, and the row handle 74 attached to the row cable 72 for performing rowing exercises. To perform the rowing exercises, the user accesses the opposite side of the boom 30 than the user accesses when using the climbing assembly 50. As previously discussed, the seat element 68 may be slidably mounted above the top surface 42 of the boom 30 when the boom 30 is in the rowing configuration. In this embodiment, the seat element 68 is mounted with sliders 73 so that when the boom 30 is in the horizontal position, a user seated on the seat element 68 may slide forward and back to perform rowing exercises. The sliders 73 may be any suitable mechanism known in the art, such as wheels guided by channels within the boom 30, ball bearings, different tracks, etc., or any other mechanism known to those skilled in the art.

As illustrated, in addition to the seat element 68, the rowing assembly 70 may further include the pair of rowing pedals 71 for receiving the user's feet while performing the rowing exercises. In various embodiments, the rowing pedals 71 may include straps 75 for securing the user's feet, as well as an adjustable grip pad 77 for different sizes of feet. The rowing pedals 71 may include any additional features known in the art for performing rowing exercises, e.g., additional straps, toe caps, etc., or any other desired features.

Figure 12:
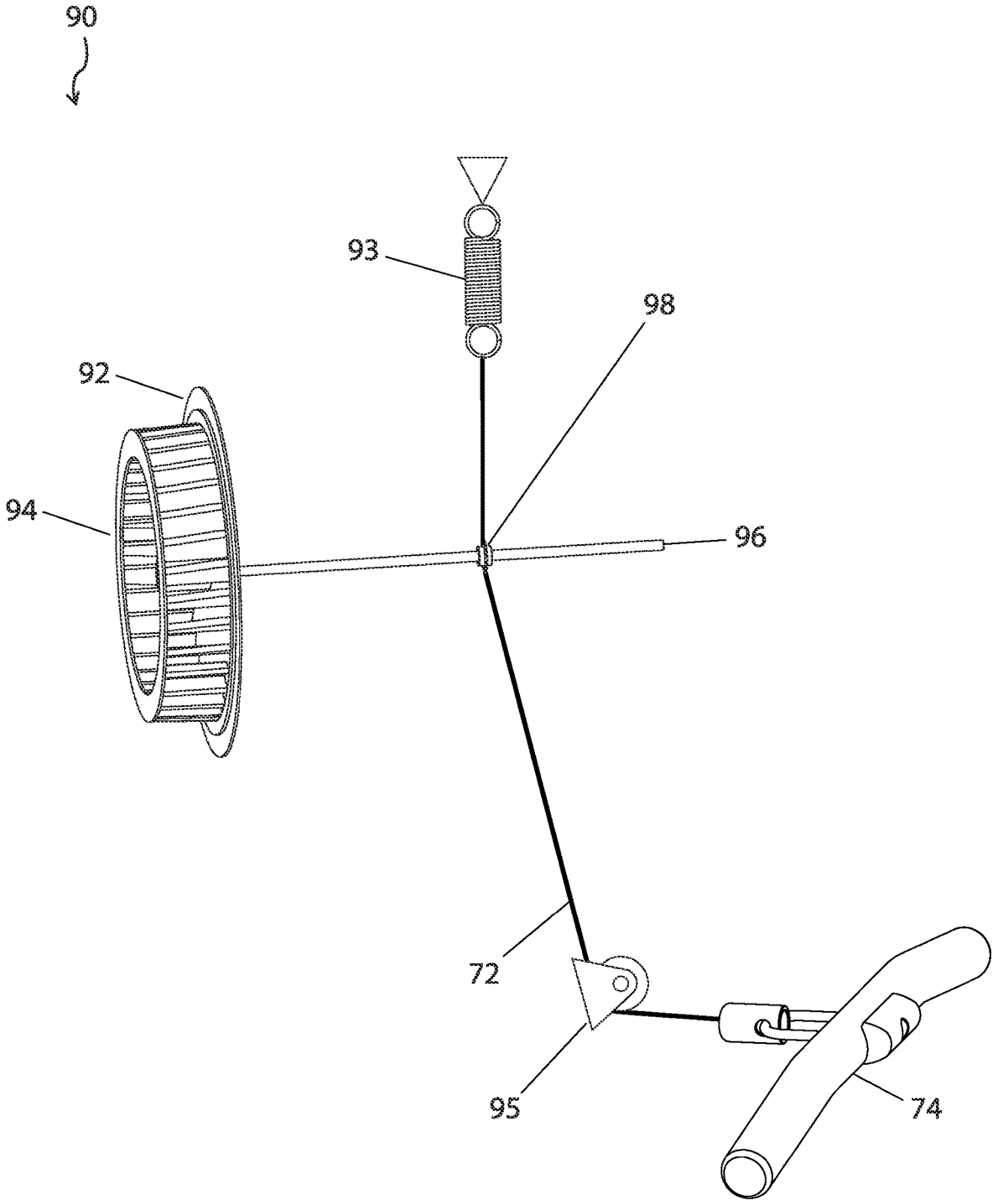
FIG. 12 is a schematic drawing of a first embodiment of a row transmission system of the exercise machine.

FIG. 12 is a schematic drawing of a first embodiment of the rowing transmission system 90 of the exercise machine 10. As shown in FIG. 12, the row handle 74 is attached to a rowing transmission system 90 that includes the row cable 72 that may extend into the elongate member 82 of the boom 30 (for protection and concealment), to the row resistance device. The row handle 74 is positioned so that when exercise machine 10 is in the rowing configuration and the user is seated on the seat element 68, he or she can grasp the row handle 74 and perform rowing exercises.

In this embodiment, the row handle 74 is in the form of a t-handle, but in other embodiments, may be any type of handle known in the art (e.g., separate handles, loops, etc.). The handle receiver 92 may be mounted on the base 20 to catch and hold the row handle 74 and hold it while not in use. In this embodiment, the row handle 74 is held in the handle receiver 92 via tension from a row resistance device. The handle receiver 92 may be in the form of a variety of attachment mechanisms/structures (e.g., receiving structures, straps, etc.) devised by those skilled in the art to hold the row handle 74 in place when not in use, and such structures should be considered within the scope of the current invention.

In this embodiment, the row resistance device 92 comprises an air displacement fan 94 positioned on a shaft 96. In this embodiment, the air displacement fan 94 and the shaft 96 are mounted concentrically relative to the lateral tube 38 and the pivot mount 26 so that they all rotates about the axis A of the lateral tube 38 (the axis A being illustrated in FIG. 2). The shaft may also have a sprocket or pulley 98 positioned concentric to the shaft 96. The sprocket/pulley 98 is driven by the row cable 72 to rotate the shaft which in turn rotates the air displacement fan 94.

In some embodiments, the row cable 72 is attached to a row recoil device 93, which functions to provide a bias towards a starting position of the row assembly 70. In this embodiment, the row recoil device 93 is in the form of a coiled spring that is anchored to the base housing. As illustrated in other figures, the row cable 72 may extend around pulleys to provide the necessary length. However, the recoil device 93 may alternatively or additionally include any recoil device known in the art, such as a coiled spring, or other elastic or recoil mechanism known in the art.

Figure 13:
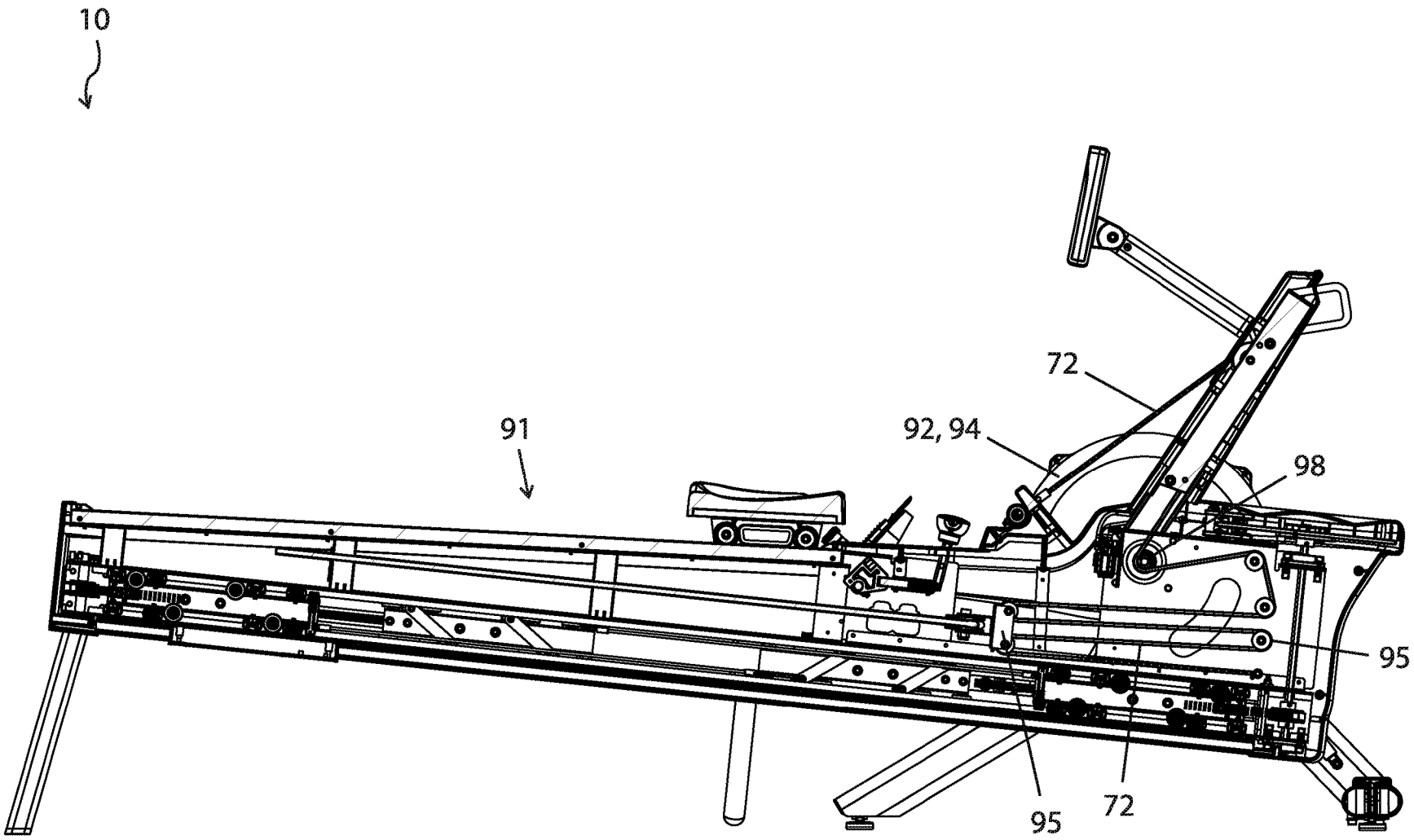
FIG. 13 is a sectional view of the exercise machine in the rowing configuration, showing a second embodiment of the row transmission system.

FIG. 13 is a sectional view of the exercise machine 10 in the rowing configuration, showing a second embodiment of the row transmission system 91. As shown in FIG. 13, in this embodiment, the transmission system 91 includes additional pulleys 95 for guiding the row cable 72 from the rowing pedals 71 and the row handle 74, around the pulleys 95, to connect with the resistance device 92, in this case around the shaft 96 of the air displacement fan 94.

In another embodiment there will be an integrated resistance system (not shown) that will be independently actuated by either the climbing assembly 50 or the rowing assembly 70. The orientation of the boom 30 will dictate which assembly (climbing or rowing) will engage the resistance system at any time. When the boom 30 is in the climbing configuration the climbing assembly 50 will engage the resistance system while the rowing assembly 70 will be disengaged from the resistance mechanism. Alternatively, when the boom 30 is in the rowing configuration the rowing assembly 70 will engage the resistance system while the climbing assembly 50 will be disengaged from the resistance mechanism. While two examples of the resistance devices are shown, alternative forms of resistance devices known to those skilled in the art may also be used, e.g., water or magnetic displacement mechanisms, friction based mechanisms, etc., which should be considered within the scope of the present invention.

Each of the cables 76 and 72 contacts the pulleys 78, 95, 87, and/or 98 such that when the pulley rotates, the shaft rotates, and operates the respective resistance device to provide resistance to a user exercising. In some embodiments, the resistance device may be driven with a chain and sprockets, toothed belt, frictional belt, pulleys, gears or other means known to those skilled in the art.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. While the invention has been described with reference to at least one particular embodiment, it is to be clearly understood that the invention is not limited to these embodiments, but rather the scope of the invention is defined by claims made to the invention.

What is claimed is:

1. An exercise machine for use by a user, the exercise machine comprising:

a base configured to support the exercise machine on a support surface;

a boom having an elongate rigid body that extends from a proximal end to a distal end, the boom having a top surface, a bottom surface, and side surfaces;

a pivot mount which pivotally mounts the proximal end of the boom on the base such that the boom is able to pivot about an axis with respect to the base between a horizontal rowing configuration wherein the boom is horizontal with respect to the support surface, and a vertical climbing configuration wherein the boom extends upwardly relative to the support surface;

a seat element slidably mounted above the top surface of the boom;

a row handle attached to a row transmission system comprising a row cable that extends to a row resistance device;

a pair of climb handles slidably mounted on the boom;

a pair of climb pedals slidably mounted on the boom; and a climber transmission system that connects the pair of climb handles and the pair of climb pedals to a climber resistance device, wherein when the exercise machine is in the horizontal rowing configuration, the row handle can be grasped by the user seated on the seat element to perform rowing exercises, and wherein when the exercise machine is in the vertical climbing configuration, the pair of handles and the pair of climb pedals can be engaged by the user to perform climbing exercises.

2. The exercise machine of claim 1, further comprising a pair of rowing pedals each positioned on one of the side surfaces of the boom.

3. The exercise machine of claim 2, further comprising adjustable locking mechanism for locking each of the rowing pedals in either a planar position wherein each of the rowing pedals is aligned with the boom, or an angled position wherein each of the rowing pedals is angled with respect to the boom.

4. The exercise machine of claim 1, wherein the climber resistance device comprises a reciprocating flywheel.

5. The exercise machine of claim 4, wherein the climber resistance device further comprises a magnetic component movably mounted adjacent the reciprocating flywheel so that the magnetic component can move relative to the reciprocating flywheel to adjust the amount of resistance provided.

6. The exercise machine of claim 1, wherein the row resistance device comprises an air displacement fan.

7. The exercise machine of claim 1, wherein the climber transmission system comprises a cable that extends around a pulley and connects each of the climb handles with the opposite climb pedal in a contralateral configuration.

8. The exercise machine of claim 1, wherein each of the climb handles include a generally rectangular frame having a top crossbar and a bottom crossbar spaced a distance from each other by a side bar.

9. The exercise machine of claim 1, further comprising a pair of legs extending outwardly and downwardly from the boom between the proximal and distal end of the boom for supporting the boom in the horizontal rowing configuration.

10. The exercise machine of claim 1, further comprising a base locking mechanism for interlocking with the boom to hold the boom in the vertical climbing configuration.

* * * * *